United States Patent [19]

LeBegue

[11] 4,076,316

[45] Feb. 28, 1978

[54] CONTINUOUS MINING MACHINE WITH LATERALLY MOVABLE CUTTER DRUM MEMBER

[75] Inventor: Maurice K. LeBegue, Ashland, Ky.

[73] Assignee: National Mine Service Company, Pittsburgh, Pa.

[21] Appl. No.: 675,141

[22] Filed: Apr. 8, 1976

Related U.S. Application Data

[63] Continuation of Ser. No. 552,857, Feb. 25, 1975, abandoned.

[51] Int. Cl.[2] ..... E21C 25/06

[52] U.S. Cl. ..... 299/64; 299/71; 299/75; 299/80

[58] Field of Search ..... 299/64, 71, 73, 75, 299/78, 80

[56] References Cited

U.S. PATENT DOCUMENTS

| | | | |
|---|---|---|---|
| 3,353,871 | 11/1967 | Arentzen | 299/71 |
| 3,469,885 | 9/1969 | Marberg | 299/71 |
| 3,617,093 | 11/1971 | Daily | 299/80 |
| 3,712,679 | 1/1973 | Amoroso | 299/80 X |
| 3,730,593 | 5/1973 | Karlovsky | 299/76 |
| 3,844,618 | 10/1974 | Delli-Gahi | 299/64 |

*Primary Examiner*—Ernest R. Purser
*Assistant Examiner*—William F. Pate, III
*Attorney, Agent, or Firm*—Stanley J. Price, Jr.; John M. Adams

[57] ABSTRACT

A self-propelled body portion is provided with a forwardly extending boom member pivotally secured thereto. The boom member includes a pair of parallel forwardly extending arm members that are pivotally secured to the body portion. A pair of parallel support members are movably secured to and extend laterally from the respective arm members. A drum member having cutting elements thereon is rotatably supported at the forward end portion of the support members. A pair of piston cylinder assemblies are secured to the respective arm members and each includes an extensible piston rod secured to a support member. The piston cylinder assemblies are connected by fluid conduits to a hydraulic valve member. A selected one of the drum member end portions may be moved laterally relative to the respective side edge of the gathering device by introducing fluid under pressure from the valve member into the piston cylinder assembly adjacent that side of the mining machine. The piston rod retracts within the assembly, and the fluid is transmitted therefrom through a conduit back to the control valve and then to the other piston cylinder assembly to extend the other piston rod therefrom. The simultaneous extension and retraction of the piston rods moves the support members laterally to one side of the body portion to position a drum member end portion within the confines of a side edge of the gathering device. With this arrangement, a selected side edge of the gathering device may be positioned abutting the mine rib to permit the gathering device to pick up the loose material adjacent the mine rib.

8 Claims, 3 Drawing Figures

CONTINUOUS MINING MACHINE WITH LATERALLY MOVABLE CUTTER DRUM MEMBER

CROSS REFERENCES TO RELATED APPLICATIONS

This application is a continuation of copending application Ser. No. 552,857, filed on Feb. 25, 1975, now abandoned entitled, "Continuous Mining Machine With Laterally Movable Cutter Drum Member".

BACKGROUND OF THE INVENTION

1. Field of the Invention

This invention relates to a continuous mining machine, and more particularly, to a continuous mining machine having a cutter drum member that is laterally movable on the mining machine relative to the gathering device to permit the respective side edge of the gathering device to be moved into position abutting the mine rib for gathering the material dislodged by the drum member adjacent the mine rib.

2. Description of the Prior Art

A full-face drum type mining machine as disclosed in U.S. Pat. No. 3,774,969 includes an elongated body portion mounted on endless tracks with a forwardly extending boom member pivotally secured to the body portion. A drum member is rotatably mounted to the forward end portion of the boom member and includes a plurality of cutting members extending outwardly from the drum member. The boom member includes a pair of parallel forwardly extending arm members that are pivotally connected to the mining machine body portion. Piston cylinder assemblies pivot the arm members vertically to thus provide for shearing cuts by the drum member. A second pair of arm members are secured to and extend laterally from the first pair of arm members. Suitable piston cylinder devices are arranged to move the second pair of arm members laterally toward and away from the first pair of fixed arm members. The lateral movement of the second arm members either extends or retracts the drum member which is rotatably supported at the forward end portion of the second arm members. A gathering device extends forwardly from the mining machine body portion and is positioned rearwardly of the drum member for gathering loose material dislodged by the drum member and feeding the dislodged material onto a conveyor that extends the length of the mining machine.

With the drum member in both an extended and retracted position, the end portions of the drum member extend beyond the parallel side edges of the gathering device. Subsequently, the material dislodged from the face by the drum member end portions adjacent the mine ribs remain beyond the gathering limits of the gathering device. Even with the drum member is retracted position, the cutting elements of the drum member end portions extend beyond the confines of the gathering device. Consequently, the gathering device cannot be maneuvered into a postion abutting the mine rib to permit the gathering device side edge portion to pick up the loose material adjacent the rib. There is a need to provide a drum member that is laterally movable with the boom member relative to the mining machine so that a selected one of the gathering device side edges may be positioned in abutting relationship with the mine rib to pick up the loose material adjacent the mine rib.

SUMMARY OF THE INVENTION

In accordance with the present invention, there is provided a continuous mining machine that includes an elongated body portion mounted on devices for propelling the body portion. A boom member is pivotally secured to the body portion and extends forwardly therefrom. A drum member having end portions is rotatably mounted on the forward end portion of the boom member transversely to the body portion. The drum member has cutting elements extending therefrom. A gathering device extends forwardly from the body portion and is operable to gather and feed material dislodged by the drum member rearwardly on the body portion. The gathering device has side edge portions. An extensible mechanism is provided for laterally moving the boom member relative to the gathering device on the body portion to position a selected one of the drum member end portions within the confines of the respective one of the gathering device side edge portions so that the side edge portion gathers the material dislodged by the respective drum member end portion.

The boom member includes a pair of parallel forwardly extending arm members that are pivotally connected to the body portion. A pair of parallel support members are movably secured to and extend laterally from the respective arm members. The drum member is rotatably supported by the support members at the forward end portion thereof and is arranged to extend and retract upon lateral movement of the support members. The extensible means includes a pair of piston cylinder assemblies, each being secured to one of the respective arm members. A piston rod is arranged to extend and retract in each of the piston cylinder assemblies. Each of the piston rods has an end portion that is secured to a respective support members. The piston cylinder assemblies each include an inlet and an outlet that are connected by fluid conduits to a hydraulic valve member that controls fluid flow to and from the assemblies.

Fluid is introduced into the piston rod end of a selected one of the piston cylinder assemblies from the valve member and is directed out of the piston end of the assembly and back to the valve member. The valve member then directs fluid into the other piston cylinder assembly in a like manner. With this arrangement, the piston rods of the respective piston cylinder assemblies are simeltaneously extended and retracted to move the support members laterally relative to the arm members. Lateral movement of the support members provides for lateral movement of the drum member so that an end portion of the drum member may be moved into alignment with or within the confines of the side edge of the gathering device to permit the gathering device to be maneuvered into abutting relationship with the mine rib for gathering the material dislodged by the respective drum member end portion adjacent the mine rib. Thus, the support members are laterally movable on the mining machine body portion to a position where a selected side edge of the gathering device extends beyond the respective end portion of the drum member.

Accordingly, the principal object of the present invention is to provide a continuous mining machine with a cutter drum member rotatably mounted at the forward end portion of a boom member and arranged for lateral movement relative to the mining machine to permit an end portion of the drum member to be moved within the confines of a side edge of the gathering device to permit maneuvering of the gathering device into abutting position with the mine rib for gathering the loose material dislodged adjacent the mine rib.

Another object of the present invention is to provide a continuous mining machine having a cutter drum member rotatably mounted by a boom member at the forward end portion of the mining machine and arranged for lateral movement relative to the mining machine body portion to position a selected one of the drum member end portions within the gathering limits of the gathering device with the cutter drum member in either extended or retracted position.

These and other objects of this invention will be more completely disclosed and described in the following specification, the accompanying drawings and the appended claims.

DESCRIPTION OF THE PREFERRED EMBODIMENTS

Figure 1:
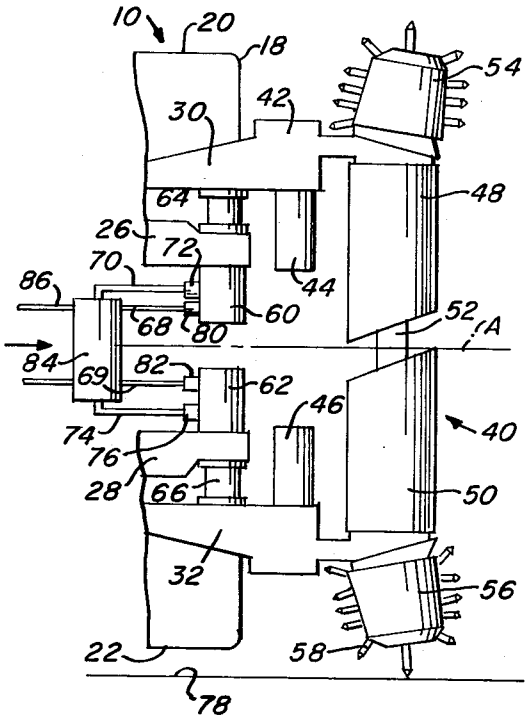
FIG. 1 is a fragmentary top plan view of a continuous mining machine illustrating the cutter drum in an extended position with the cutter drum end portions extending beyond the side edges of the gathering device.

Referring to the drawings, there is illustrated a continuous mining machine generally designated by the numeral 10 that has a body or frame portion 12 suitably mounted on endless crawler tracks 14. Hydrauic motors (not shown) are provided to propel the mining machine 10 on the endless crawler tracks 14 to advance the mining machine during the mining operation. An endless conveyor mechanism 16 is positioned longitudinally on the body portion 12 and conveys dislodged material from the forward end portion of the mining machine to a rearward discharge end portion (not shown). The conveyor mechanism 16 and the discharge end portion of the mining machine are illustrated and described in greater detail in U.S. Pat. No. 3,774,969. A gathering device 18 having side edge portions 20 and 22 extends forwardly from the body portion 12. The gathering device 18 is arranged to gather the material dislodged from the mine face by the continuous mining machine and feed the dislodged material onto the conveyor mechanism 16 for transportation rearwardly to the mining machine discharge end portion.

Figure 3:
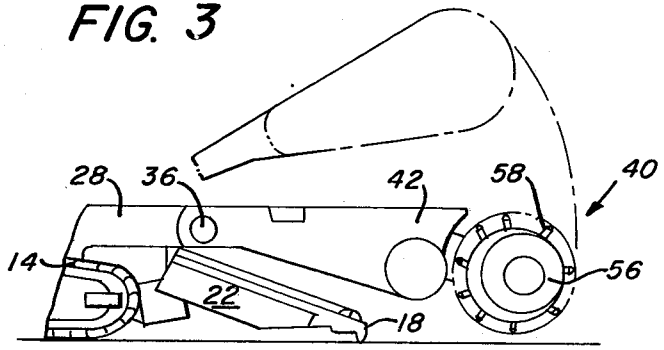
FIG. 3 is a fragmentary view in side elevation, of the mining machine illustrated in FIGS. 1 and 2 with the path followed by the cutter drum shown in dotted lines.

A boom member 24 extends forwardly of the machine body portion 12 and includes a pair of forwardly extending arm members 26 and 28. The boom arm members 26 and 28 are pivotally connected (in a manner not shown) at their rearward end portions to the body portion 12 and are arranged to pivot about their rear end portions upwardly through a vertical path as illustrated in phantom in FIG. 3. In this manner, the boom member 24 is operable to pivot relative to the body portion 12 to dislodge material from the mine face by upward and downward shear cuts.

The boom member 24 also includes a pair of parallel support members 30 and 32. The support members 30 and 32 are positioned laterally of the boom arm members 26 and 28 and extend forwardly therefrom. The support members 30 and 32 are supported on cylindrical members 34 and 36 that are secured to and extend laterally from the respective arm members 26 and 28. The rearward end portions of the support members 30 and 32 include a cylindrical recess 38 that is arranged to slidably receive the cylindrical members 34 and 36. With this arrangement, the support members 30 and 32 may move laterally toward and away from the arm members 26 and 28.

A cutter drum member generally designated by the numeral 40 is rotatably supported from a housing 42 that forms a portion of the support members 30 and 32. Suitable drum rotating motors 44 and 46 are secured to the laterally movable support members 30 and 32. The motors are operable, as described in greater detail in U.S. Pat. No. 3,774,969, to rotate the cutter drum 40. The motors 44 and 46 are connected through a clutch mechanism and drive train to the gearing within the cutter drum member 40 for rotating the cutter drum member 40 to dislodge material from the mine face.

Figure 2:
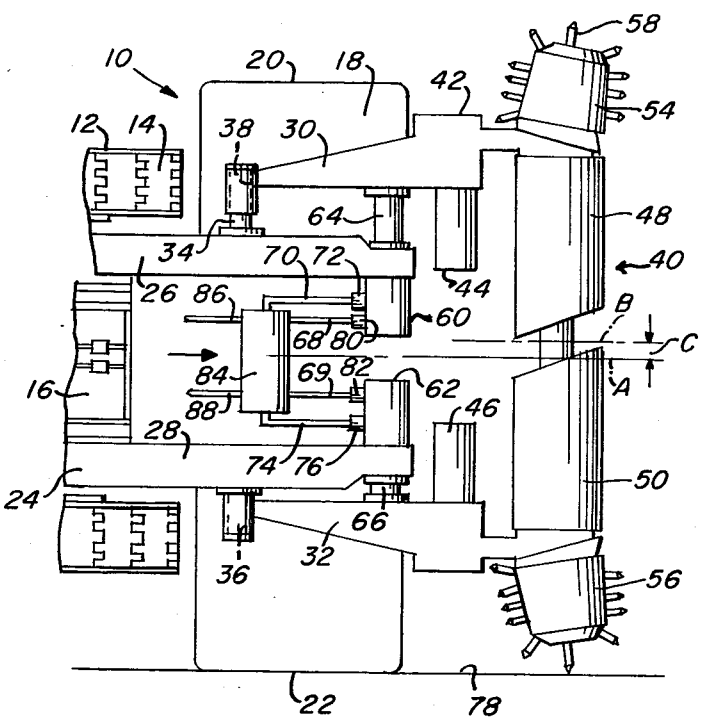
FIG. 2 is a fragmentary top plan view of the mining machine similar to FIG. 1, illustrating the cutter drum in an extended position and shifted on the machine boom member to a position where a cutter drum end portion is aligned with the side edge of the gathering device adjacent the rib portion of the mine entryway.

The cutter drum member 40 includes intermediate sections 48 and 50 that are movably connected to each other by a shaft 52, illustrated in FIG. 2. A pair of canted end portions 54 and 56 are rotatably supported by the support member housing 42 for rotation with the intermediate portions 48 and 50. The respective intermediate portion 48 and end portion 54 and intermediate portion 50 and end portion 56 are arranged to move as units toward and away from each other on the connecting shaft 52 to extend and retract the cutter drum member 40. The intermediate portions 48 and 50, as well as the canted end portions 54 and 56, are provided with a plurality of cutting elements 58 that extend radially outwardly from the respective cutter drum members. The bit pattern for the respective cutter drum members is arranged to overlap in both the cutter drum member extended and retracted positions so that the cutter drum member 40 dislodges material along the entire length of the mine face. In this manner, a continuous kerf of material is dislodged from the mine face without leaving unmined or dislodged portions in the face.

As disclosed in U.S. Pat. No. 3,774,969, the support arms 30 and 32 are laterally movable on the cylindrical members 34 and 36 relative to the fixed arm members 26 and 28 by operation of extension piston cylinder assemblies 60 and 62 to extend and retract the cutter drum member 40 to thereby dislodge a kerf of preselected length from the mine face. The extension piston cylinder assemblies 60 and 62 are secured to the fixed arm members 26 and 28, respectively. The assemblies 60 and 62 are provided with a cylinder having extensible piston rods 64 and 66 extending outwardly therefrom. The piston rods 64 and 66 are secured to the respective support members 30 and 32 and to the piston within the cylinder of the respective assemblies 60 and 62.

The piston cylinder assemblies 60 and 62 are provided with fluid inlets 72 and 76 and fluid outlets 80 and 82, respectively, that are connected by conduits 68, 69, 70 and 74 to a hydraulic valve member 84 positioned on the frame portion 12 between the arm members 26 and 28. The valve member 84 controls the flow of pressurized hydraulic fluid between a source (not shown) and the piston cylinder assemblies 60 and 62. The valve member 84 is connected to the pressurized source of fluid by fluid conduits 86 and 88.

The hydraulic valve 84 is operable to actuate the assemblies 60 and 62 to control the flow of hydraulic fluid from the pressurized source to and from the piston cylinder assemblies 60 and 62 to thereby move the support members 30 and 32, together with the cutter drum 40, laterally with respect to the gathering device 18. The valve member 84 is also operable to actuate a single piston cylinder assembly and extend one; while, the other remains retracted.

As illustrated in FIG. 1, the cutter drum member 40 is extended to dislodge a continuous kerf of material from the mine face as the mining machine forwardly advances the cutter drum member 40. With this arrangement, the gathering device 18 has a longitudinal axis A that passes through the center portions of the gathering device 18 and drum member 40. In the mining operation, the gathering device 18 is positioned rearwardly of the drum member 40 and directs the dislodged material in a conventional manner onto the conveyor mechanism 16. As illustrated in FIG. 1, the outer limits of the canted end portions 54 and 56 extend beyond the confines or limits of the gathering device side edges 20 and 22. Consequently, the dislodged material, for example, that is deposited on the mine floor and located between the outer limits of the gathering device 18 and the mine rib 78 remains in place on the mine floor.

By operation of the piston cylinder assemblies 60 and 62, the support members 30 and 32 may be moved laterally on the cylindrical members 34 and 36 to position a selected one of the drum member end portions 54 or 56 within the gathering confines of the respective gathering device side edge 20 or 22. Thus, with the drum member end portion positioned within the limits or confines of the gathering device, the material remaining in place adjacent the mine rib is directed onto the gathering device 18 and fed therefrom onto the conveyor mechanism 16.

In the conventional practice of dislodging coal from the mine face by the continuous mining machine 10, the machine 10 forwardly advances the extended cutter drum member 40 into the mine face to cut a kerf therefrom of a width corresponding to the width of the cutter drum 40. After advancing the cutter drum 40 a preselected distance, the mining machine 10 reverses direction and moves away from the face. Thereafter, the mining machine 10 is positioned in the entryway to expand the width of the entry by making a second cut adjacent to and overlapping the first cut. The mining machine 10 advances the cutter drum 40 into the uncut portion of the face to the depth of the first cut. Thus, an entryway is formed having a width greater than the width of the cutter drum 40.

During the mining operation, the dislodged material is transferred between gathering device 10 onto the mining machine conveyor 16. However, the dislodged material deposited on the mine floor adjacent the mine rib 78 lies beyond the lateral side edge 22 of the gathering device 18 as illustrated in FIG. 1, With the drum end portion 56 extending beyond the lateral side edge 22, the mined material remains in place on the mine floor between the side edge 22 and rib 78. In accordance with the present invention, the cutter drum 78 is moved laterally on the mining machine 10 to permit positioning of the gathering device side edge 22 abutting the mine rib 78 to pick up the ungathered material.

The drum member end portion 56 is laterally moved on the mining machine 10 to a position within the confines of the gathering device side edge 22 as illustrated in FIG. 2, by initially conducting fluid under pressure from the valve member 84 through conduit 74 and inlet 76 into piston cylinder assembly 62. Introducing fluid into the piston rod end of assembly 62 advances the piston within the cylinder to, in turn, retract the piston rod 66 within the cylinder. The fluid remaining at the opposite end portion of the cylinder adjacent outlet 82 is directed by the piston through outlet 82 into conduit 69 and back to the valve member 84. Thereafter, the valve member 84 directs pressurized fluid through conduit 68 and outlet 80 into the piston end of the piston cylinder assembly 60.

Introducing fluid into the cylinder of assembly 60 advances the piston therein and extends the piston rod 64 outwardly from the cylinder. The excess fluid is returned to the valve member 84 through cylinder inlet 72 and conduit 70. Thus, the retraction of piston rod 66 within piston cylinder assembly 62 and the extension of piston rod 64 from piston cylinder assembly 60 laterally moves the support members 30 and 32 together with the drum member 40 to a position where the drum member end portion 56 is either aligned with the gathering device edge portion 22 or the end portion 22 extends laterally beyond the drum end portion 56. Thus, the mid point B of the drum member 40 is transversely displaced from the longitudinal axis A of the gathering device 18 a preselected distance C. The mining machine 10 then may be forwardly advanced so that the material dislodged from the mine face and remaining on the mine floor adjacent the mine rib 78 is directed onto the gathering device 18.

As illustrated in FIG. 2, the lateral movement of the drum member 40 aligns the drum member end portion 56 with the gathering device 18 to permit the gathering device side edge 22 to be positioned in substantially abutting relationship with the mine rib 78. Not only may the drum member 40 be moved relative to the minine machine body portion 12 for gathering the loose material adjacent the mine rib but by moving the drum member 40 as above described, the clearance between the drum end portion 54 and the gathering device side edge 20 is increased to facilitate the cutting of turns in the mine.

Moving the drum member 40 laterally relative to the gathering device 18 for positioning the drum member end portion 54 within the confines of the gathering device side edge 20 is accomplished by lateral movement of the support members 30 and 32 together with the drum member 40 toward the mine rib 78. Fluid under pressure is directed by the valve member 84 through conduit 70 and inlet 72 into the piston cylinder assembly 60. Introducing fluid into the cylinder of the assembly 60 moves the piston toward the rear portion of the assembly. The moving piston urges the fluid in the rear portion of the assembly through the outlet 80 and conduit 68 back to the valve member 84. The valve member 84 then transmits the fluid through conduit 69 into the outlet 82 of piston cylinder assembly 62. Fluid entering the cylinder through outlet 82 advances the piston forwardly in the cylinder, forcing fluid to exit the assembly 62 through inlet 76 and conduit 74 back to the valve member 84. In this manner, the piston rod 64 of piston cylinder assembly 60 retracts within the assembly while piston rod 66 of piston cylinder assembly 62 extends outwardly therefrom. Further, in accordance with the present and invention, the valve member 84 is operable to actuate either of the piston cylinder assemblies 60 or 62 to extend the respective assembly while the other remains inactive.

Retraction of piston rod 64 and extension of piston rod 66 laterally moves the support arms 30 and 32 on the cylindrical members 34 and 36 respectively until the outer limit of the drum member end portion 54 is aligned with the gathering device side edge 20. Further, in accordance with the present invention, additional retraction of piston rod 64 and extension of piston rod 66 will move the support arms 30 and 32 so that the outer limit of the drum member end portion 54 is positioned within the confines of the gathering device side edge 20. With this arrangement, side edge 20 extends beyond end portion 54. Accordingly, the drum member end portion 56 will extend substantially beyond the gathering device side edge 22. With the gathering device side edge 20 unobstructed by the drum member end portion 54, the mining machine 10 may be maneuvered to position the gathering device side edge 20 in abutting relationship with the mine rib (not shown) opposite the main rib 78 of the mine entryway. Forwardly propelling the mining machine 10 in this position enables the gathering device to pick up and transfer onto the conveyor mechanism 16, the dislodged material remaining on the mine floor and which would normally be beyond the limits of the gathering device 18. Further, in accordance with the present invention, the mining machine 10 may be forwardly advanced through the mine with the drum member end portion 56 in extended position beyond the gathering device side edge 22 for cutting a turn in the mine in a direction opposite to that above described.

According to the provisions of the patent statutes, I have explained the principle, preferred construction and mode of operation of my invention and have described what I now consider to represent its best embodiments. However, it should be understood that, within the scope of the appended claims, the invention may be practiced otherwise than as specifically illustrated and described.

I claim:

1. A continuous mining machine comprising, an elongated body portion mounted on means for propelling said body portion, a boom member pivotally secured to said body portion and extending forwardly therefrom, said boom member including support means positioned laterally of said boom member and extending forwardly therefrom, said support means connected to said boom member for slidable movement laterally toward and away from said boom member, a unitary drum member rotatably supported by said support means at the forward end portion thereof transversely to said body portion for lateral movement thereto, said unitary drum member having end portions and an intermediate portion therebetween, said unitary drum member having cutting elements extending therefrom to cut a continuous kerf from the mine face, a gathering device extending forwardly from said body portion for gathering and feeding material dislodged by said unitary drum member rearwardly from said body portion, said gathering device having side edge portions, means to elongate said unitary drum member to an extended position, said unitary drum member in an extended position having a length greater than the width of said gathering device, extensible means to move a portion of said support means laterally toward said boom member and simultaneously move a second portion of said support means laterally away from said boom member, and said extensible means operable upon actuation to laterally move said boom member support means and thereby laterally move said unitary drum member relative to said gathering device on said body portion to a position where a selected one of said gathering device side edges extends beyond the respective one of said unitary drum member end portions so that said gathering device side edge gathers the material dislodged by said unitary drum member end portion.

2. A continuous mining machine as set forth in claim 1 wherein, said boom member includes a pair of parallel forwardly extending arm members pivotally connected to said body portion at the rearward end portions of said arm members for vertical pivotal movement, said boom member support means including a pair of parallel support members movably secured to and laterally extending from said respective arm members, cylindrical means secured to and extending outwardly from said respective arm members for slidably supporting said support members at the rearward portions thereof for lateral movement toward and away from said arm members, and said unitary drum member being rotatably supported by said support members at the forward end portion thereof and arranged to extend and retract upon lateral movement of said support members.

3. A continuous mining machine as set forth in claim 2 which includes, said extensible means being supported at the forward end portions of said arm members and rigidly connected to said support members, said extensible means operable to move said support members together with said unitary drum member laterally from side to side of said body portion and thereby move either of said unitary drum member end portions within the lateral confines of a respective side edge of said gathering device.

4. A continuous mining machine as set forth in claim 2 in which extensible means includes, a pair of piston cylinder assemblies, each secured to one of said respective arm members, a piston rod arranged to extend and retract within each of said piston cylinder assemblies, each of said piston rods having an end portion extending laterally of said arm member and rigidly secured to said support members respectively to maintain said support members in spaced parallel relation with said arm members on said body portion as said support members move laterally toward and away from said arm members, valve means for controlling the flow of fluid under pressure to and from said pair of piston cylinder assemblies, conduit means for connecting said valve means with said pair of piston cylinder assemblies to direct said fluid therebetween and said valve member, and said valve means operable to selectively supply fluid under pressure to said pair of said piston cylinder assemblies so that fluid therein displaces said piston rods to simultaneously extend and retract said piston rods respectively to move said support members laterally toward and away from said arm members.

5. A continuous mining machine as set forth in claim 2 which includes, a cylindrical member secured to and projecting laterally outwardly from each of said arm members, said support members each having a cylindrical recess adjacent the rearward end portion thereof for slidably receiving said cylindrical member, and said extensible means operable upon actuation to move said support members in a preselected direction on said cylindrical members toward and away from said arm members.

6. A continuous mining machine as set forth in claim 5 which includes, said unitary drum member rotatably connected to the forward end portion of said support members, said unitary drum member laterally movable with said support members relative to said arm members between a first position with one of said unitary drum member end portions extending laterally beyond the respective one of said gathering device side edges and a second position with said one of said unitary drum member end portions extending laterally within the respective one of said gathering device side edges.

7. A continuous mining machine comprising, an elongated body portion mounted on means for propelling said body portion, a boom member pivotally secured to said body portion and extending forwardly therefrom, said boom member including support means positioned laterally of said boom member and extending forwardly therefrom, said support means connected to said boom member for slidable movement laterally toward and away from said boom member, a unitary drum member rotatably supported by said support means at the forward end portion thereof transversely to said body portion for lateral movement thereto, said unitary drum member having end portions and a pair of intermediate portions extending between said end portions, said unitary drum member having cutting elements extending therefrom to cut a continuous kerf from the mine face, means for nonrotatably connecting said intermediate portions to each other, means for moving said intermediate portions together with said respective end portions toward and away from each other to thereby extend and retract said unitary drum member, a gathering device extending forwardly from said body portion for gathering and feeding material dislodged by said unitary drum member rearwardly from said body portion, said gathering device having side edge portions, and said extensible means operable upon actuation to laterally move said support means with said unitary drum member being in an extended position to a position on said boom member with one of said unitary drum member end portions being positioned within the lateral confines of one of said gathering device side edges.

8. A continuous mining machine as set forth in claim 1 which includes, said gathering device having a longitudinal axis, said unitary drum member having a mid point aligned with said gathering device longitudinal axis, and said extensible means operable to laterally move said boom member support members relative to said gathering device on said body portion and thereby displace said unitary drum member mid point transversely of said gathering device longitudinal axis.

* * * * *